US009566483B2

(12) United States Patent
Roach et al.

(10) Patent No.: US 9,566,483 B2
(45) Date of Patent: Feb. 14, 2017

(54) GOLF CLUB HEAD WITH UNDERCUT

(71) Applicant: Cobra Golf Incorporated, Carlsbad, CA (US)

(72) Inventors: Ryan L. Roach, Carlsbad, CA (US); Christopher B. Best, New Bedford, MA (US)

(73) Assignee: Cobra Golf Incorporated, Carlsbad, CA (US)

( * ) Notice: Subject to any disclaimer, the term of this patent is extended or adjusted under 35 U.S.C. 154(b) by 283 days.

(21) Appl. No.: 14/336,559

(22) Filed: Jul. 21, 2014

(65) Prior Publication Data

US 2014/0329617 A1 Nov. 6, 2014

Related U.S. Application Data

(63) Continuation of application No. 13/911,274, filed on Jun. 6, 2013, now Pat. No. 8,808,109, which is a (Continued)

(51) Int. Cl.
*A63B 53/04* (2015.01)

(52) U.S. Cl.
CPC ..... *A63B 53/047* (2013.01); *A63B 60/54* (2015.10); *A63B 2053/0433* (2013.01); *A63B 2053/0454* (2013.01); *A63B 2053/0491* (2013.01)

(58) Field of Classification Search
USPC ..... 473/324–350
See application file for complete search history.

(56) References Cited

U.S. PATENT DOCUMENTS 4,928,972 A * 5/1990 Nakanishi ..... A63B 53/04 473/332
5,048,834 A * 9/1991 Gorman ..... A63B 53/04 473/350

(Continued)

FOREIGN PATENT DOCUMENTS

JP 07299165 A * 11/1995
JP 2001190720 A * 7/2001

(Continued)

*Primary Examiner* — Alvin Hunter
(74) *Attorney, Agent, or Firm* — Brown Rudnick LLP; Mark S. Leonardo

(57) ABSTRACT

A golf club head having a translucent insert disclosed. The club head includes a body defining a striking face, a top line, a sole, a back, a heel, and a toe. The back contains a cavity that extends in a direction substantially perpendicular to the face. A recess is provided within the cavity, with the recess extending away from the cavity and toward the sole. The recess causes more of the club head mass to be oriented towards the perimeter of the club head, and optionally also toward the back of the club head. This enlarges the club sweet spot and increases the moment of inertia, and facilitates imparting a desired flight path to a struck golf ball, producing a more forgiving club. The recess may have a varying depth and/or a varying draft angle. A rear wall of the recess may be provided with a cutout to further reposition mass toward the club head perimeter. A translucent insert, such as a vibration dampening member, may be provided within the recess. The insert may contain secondary inserts, such as weight members, therein in strategic locations. The insert may completely fill the recess, or may fill only a portion thereof.

20 Claims, 10 Drawing Sheets

Related U.S. Application Data continuation of application No. 13/296,818, filed on Nov. 15, 2011, now Pat. No. 8,480,515, which is a continuation of application No. 12/696,211, filed on Jan. 29, 2010, now Pat. No. 8,079,919, which is a continuation of application No. 11/802,340, filed on May 22, 2007, now Pat. No. 7,654,914, which is a continuation-in-part of application No. 10/828,209, filed on Apr. 21, 2004, now Pat. No. 7,238,119.

(56) References Cited

U.S. PATENT DOCUMENTS 5,048,835 A * 9/1991 Gorman ..... A63B 53/04 473/350
5,643,111 A * 7/1997 Igarashi ..... A63B 53/04 273/DIG. 8
5,695,411 A * 12/1997 Wright ..... A63B 53/04 473/332
5,722,900 A * 3/1998 Sung ..... A63B 53/04 473/291
6,497,629 B2 * 12/2002 Takeda ..... A63B 53/04 29/557
6,688,989 B2 * 2/2004 Best ..... A63B 53/04 473/332
6,709,345 B2 * 3/2004 Iwata ..... A63B 53/04 473/291
6,719,641 B2 * 4/2004 Dabbs ..... A63B 53/04 473/291
6,811,496 B2 * 11/2004 Wahl ..... A63B 53/047 473/334
6,849,005 B2 * 2/2005 Rife ..... A63B 53/047 473/290
7,022,028 B2 * 4/2006 Nagai ..... A63B 53/04 473/291
7,083,525 B2 * 8/2006 Pond ..... A63B 53/04 273/DIG. 14
7,186,188 B2 * 3/2007 Gilbert ..... A63B 53/047 473/290
7,192,362 B2 * 3/2007 Gilbert ..... A63B 53/047 473/291
7,220,189 B2 * 5/2007 Wieland ..... A63B 53/0466 473/342
7,232,381 B2 * 6/2007 Imamoto ..... A63B 53/047 473/345
7,238,119 B2 * 7/2007 Roach ..... A63B 53/047 473/332
7,390,270 B2 * 6/2008 Roberts ..... A63B 53/047 473/332
7,410,427 B2 * 8/2008 Imamoto ..... A63B 53/047 473/345
7,559,850 B2 * 7/2009 Gilbert ..... A63B 53/047 473/290
7,563,176 B2 * 7/2009 Roberts ..... A63B 53/047 473/329
7,575,523 B2 * 8/2009 Yokota ..... A63B 53/0466 473/332
7,578,754 B2 * 8/2009 Nakamura ..... A63B 53/047 473/342
7,594,864 B2 * 9/2009 Sukman ..... A63B 53/047 473/334
7,604,549 B2 * 10/2009 Sugimoto ..... A63B 53/047 473/342
7,654,914 B2 * 2/2010 Roach ..... A63B 53/047 473/349
7,749,105 B2 * 7/2010 Zielke ..... A63B 53/0487 473/350
7,789,772 B2 * 9/2010 Sukman ..... A63B 53/047 473/334
7,892,106 B2 * 2/2011 Matsunaga ..... A63B 53/047 473/290
7,922,604 B2 * 4/2011 Roach ..... A63B 53/047 473/332
7,972,222 B2 * 7/2011 Llewellyn ..... A63B 53/0475 473/291
8,079,919 B2 * 12/2011 Roach ..... A63B 53/047 473/350
8,808,109 B2 * 8/2014 Roach ..... A63B 53/047 473/350
9,011,270 B2 * 4/2015 Nakano ..... A63B 53/047 473/312
2003/0199331 A1 * 10/2003 Stites, III ..... A63B 53/0466 473/290
2005/0043111 A1 * 2/2005 Albert ..... A63B 53/04 473/324
2005/0085312 A1 * 4/2005 Nagai ..... A63B 53/04 473/291

FOREIGN PATENT DOCUMENTS

JP 2005137794 A * 6/2005
JP 2005143591 A * 6/2005
JP 2005305179 A * 11/2005
JP 2007289513 A * 11/2007
JP 2009226062 A * 10/2009
JP 2010029544 A * 2/2010

* cited by examiner

GOLF CLUB HEAD WITH UNDERCUT

CROSS-REFERENCE TO RELATED APPLICATIONS

This application is a continuation of U.S. patent application Ser. No. 13/911,274, filed Jun. 6, 2013, which is a continuation of U.S. patent application Ser. No. 13/296,818, filed Nov. 15, 2011, now U.S. Pat. No. 8,480,515, which is a continuation of U.S. patent application Ser. No. 12/696,211, filed Jan. 29, 2010, now U.S. Pat. No. 8,079,919, which is a continuation of U.S. patent application Ser. No. 11/802,340, filed May 22, 2007, now U.S. Pat. No. 7,654,914, which is a continuation-in-part of U.S. patent application Ser. No. 10/828,209 filed on Apr. 21, 2004, now U.S. Pat. No. 7,238,119, the contents of each of which are incorporated herein by reference in their entirety.

FIELD OF THE INVENTION

The present invention relates to a golf club head, and, more particularly, to a golf club head having an undercut with an insert.

BACKGROUND

Iron-type golf clubs generally include a front or striking face, a top line, and a sole. The front face interfaces with and strikes the golf ball. A plurality of score lines or grooves is positioned on the face to assist in imparting spin to the ball. The top line is generally configured to have a particular look to the golfer and to provide weight. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 3 or 4 through number 9, and a pitching wedge. Other wedges, such as a gap wedge, a sand wedge, and a lob wedge, may be optionally included with the set. Each iron has a shaft length that usually decreases through the set as the loft for each club head increases from the long irons to the short irons. The length of the club, along with the club head loft and center of gravity location, impart various performance characteristics to the ball's launch conditions upon impact and determine the distance the ball will travel. Flight distance generally increases with a decrease in loft angle and an increase in club length. However, difficulty of use also increases with a decrease in loft angle and an increase in club length.

Iron-type golf clubs generally can be divided into two categories: blades and cavity backs. Blades are traditional clubs with a substantially uniform appearance from the sole to the top line, although there may be some tapering from sole to top line.

Blade designs have a small sweet spot (that is, the area of the face that results in a desirable golf shot upon striking a golf ball), and therefore they are relatively difficult to use and are therefore typically only used by skilled golfers. However, these clubs have the benefit of producing longer golf shots than other designs. Furthermore, since these designs are typically made of relatively soft forged steel, they allow the golfer to work the ball and shape the golf shot as desired.

Cavity backs move some of the club mass to the perimeter of the club by providing a hollow or cavity in the back of the club, opposite the striking face. The perimeter weighting created by the cavity increases the club's moment of inertia, which is a measurement of the club's resistance to torque, for example the torque resulting from an off-center hit. This produces a more forgiving club with a larger sweet spot. Moving weight to the perimeter allows the size of the club face to be increased, also resulting in a larger sweet spot. These clubs are easier to hit than blades, and are therefore more readily usable by less-skilled and beginner golfers.

Other known golf clubs achieve a desired balance or moment of inertia by adding a weight to the club. These clubs typically add a weight member to the bottom surface of the sole, in the center thereof.

SUMMARY

The present invention relates to a golf club head having an undercut. The club head includes a body defining a striking face, a top line, a sole, a back, a heel, and a toe. The back contains a cavity that extends in a direction substantially perpendicular to the face. A recess is provided within the cavity, with the recess extending away from the cavity and toward the sole. The recess causes more of the club head mass to be oriented towards the perimeter of the club head. This enlarges the club sweet spot and increases the moment of inertia, producing a more forgiving club. The golf club head preferably is an iron-type golf club head.

To further move mass towards the club head perimeter, the recess may have a varying depth. If so, the recess includes a heel portion including a first depth, a toe portion including a second depth, and a central portion intermediate the heel and toe portions including a third depth. The third depth is greater than the first and second depths, displacing mass away from the center of the club head and toward the perimeter of the club head. The first and second depths may be substantially equal, or they may be different. If the golfer tends to hook the ball, the first depth is greater than the second depth, which places more mass toward the toe of the club. If the golfer tends to slice the ball, the first depth is less than the second depth, which places more mass toward the heel of the club. In any event, the third depth is preferably from approximately 0.05 inch to approximately 1 inch. The recess depth may preferably be varied throughout the clubs in the set. Since longer clubs are more difficult to use, the recess is more accentuated for the long irons than for the short irons. Preferred depths for the short irons include from approximately 0.05 inch to approximately 0.5 inch, and preferred depths for the middle and long irons include from approximately 0.2 inch to approximately 1 inch.

An additional measure to displace club head mass to the perimeter includes providing a varying draft angle. The draft angle is the angle within the recess between the front and back walls of the recess. These walls, which are the club head back and a rear wall, define the recess. The heel portion of the recess includes a first draft angle, the toe portion includes a second draft angle, and the central portion includes a third draft angle. The third draft angle is greater than the first and second draft angles, further displacing mass from the central region to the perimeter of the club head and increasing the moment of inertia. The first and second draft angles may be substantially equal, or they may be different. If the golfer tends to hook the ball, the first draft angle is greater than the second draft angle, which places more mass toward the toe of the club. If the golfer tends to slice the ball, the first draft angle is less than the second draft angle, which places more mass toward the heel of the club. In any event, the first and second draft angles preferably are from approximately 5 degrees to approximately 25 degrees, more preferably from approximately 20 degrees to approximately 25 degrees, and the third draft angle preferably is from approximately 30 degrees to approximately 45 degrees, more preferably from approximately 35 degrees to approximately 40 degrees.

The recess may further include a supplemental portion intermediate the central and toe portions having a fourth draft angle. The fourth draft angle preferably is greater than the third draft angle. A preferred range for the fourth draft angle is from approximately 35 degrees to approximately 60 degrees, more preferably from approximately 35 degrees to approximately 50 degrees.

The rear wall may be curved outward in a central portion thereof, which has a similar effect as a varying draft angle.

The club head may be provided with both a varying recess depth and a varying recess draft angle, thereby providing multiple means of displacing mass from the center of the club head to the perimeter of the club head.

To further displace mass towards the club head perimeter, the rear wall may contain a cutout in a central portion thereof. An indicia, such as a logo or other identifying mark, may be provided on the back of the club head. The cutout is preferably aligned with the indicia such that the indicia is visible through the cutout. The cutout may take any desired shape. Preferred shapes include, for example, circular, elliptical, oval, triangular, and trapezoidal. The cutout does not have to contain the entire shape. Rather, the cutout may take on only a portion of a shape. For example, the cutout may be, at least in part, a trapezoid, such that the cutout takes on the appearance of a chevron. A preferred circular shape has a diameter substantially equal to the diameter of a golf ball, which may be 1.68 inches.

An insert, such as a weight member or a dampening member or a medallion, may be positioned within the recess. The insert may be secured within the recess using an adhesive and/or a mechanical fastener. Preferred dampening materials, which diminish vibrations in the club head, including vibrations generated during an off-center hit, include urethane and rubber. The insert may completely fill the recess, or may fill only a portion thereof. The insert may include a main body with a top surface and legs extending away from the top surface toward the bottom of the recess. The legs may or may not extend all the way to the bottom of the recess. The insert is aligned with the top of the recess to provide a clean look to the golf club head.

The insert is configured according to the recess in which it will be used. If the recess has a varying depth, the insert will have a varying depth corresponding to the recess depths. Following the discussion above regarding the recess depths, the insert includes a heel portion including a first depth corresponding to the recess first depth, a toe portion including a second depth corresponding to the recess second depth, and a central portion intermediate the heel and toe portions including a third depth corresponding to the recess third depth. Likewise, if the recess has a varying draft angle, the insert will have a varying width corresponding to the recess widths, which are a function of the recess draft angles. Following the discussion above regarding the recess draft angle, the insert includes a heel portion including a first width corresponding to the recess first width, a toe portion including a second width corresponding to the recess second width, and a central portion intermediate the heel and toe portions including a third width corresponding to the recess third width. The club head body, and therefore the insert as well, may be shaped so as to bias the club head weight not only towards the perimeter of the club head, but also towards the rear of the club head to further facilitate playability of the resulting golf club. If the recess has a cutout, the insert will have a corresponding cutout such that the insert is substantially aligned with the top surface of the rear wall.

If an indicia is provided on the back of the club head, the insert may be provided with a hole therethrough. The hole is aligned with the indicia such that the indicia is visible through the hole. Alternatively, the insert is substantially translucent and the indicia is visible through the insert without requiring a hole. As another alternative, the insert may include an indentation therein and a second insert may be attached to the insert within the indentation. In this case, the second insert may contain an indicia thereon. To hold the second insert securely in place, the insert may contain a counterbore and the second insert may be attached to the insert within the counterbore. The second insert is preferably adapted to be locked in place within the counterbore, such as with a tongue and groove arrangement.

A plate may be attached to the insert, preferably to the top of the insert. The plate may contain perforations, such as elongated slots. The elongated slots may be arranged such that they are substantially parallel to a longitudinal axis of the golf club head, such that they are substantially perpendicular to a longitudinal axis of the golf club head, or askew to a longitudinal axis of the golf club head. If perforations are included, the insert and the plate preferably are of differing colors such that the insert will be visible through the perforations. Optionally, the plate may contain an indicia thereon. The plate may be formed, at least in part, of one or more of metal, plastic, urethane, or a composite. Alternatively, the insert is a multilayer insert including a first insert layer and a second insert layer. The insert layers may be of differing materials, and preferably have different stiffnesses. This setup allows one of the insert layers to absorb vibrations and the other insert layer to help provide a solid feel to the golf club. The layers may be arranged in any desirable manner, with a preferred arrangement being the more resilient layer being placed within a lower portion of the recess and the stiffer layer being attached atop the more resilient layer. Alternatively, the positioning of the layers can be reversed. The top layer may also include perforations therein, as previously discussed.

The insert may contain one or more secondary inserts, such as weight members, therein. In one arrangement, a weight member is positioned in a central portion of the insert. In another arrangement, a first weight member is positioned in a heel portion of the insert, and a second weight member is positioned in a toe portion of the insert. The first and second weight members may be of substantially the same mass, or they may be of differing masses. If the golfer tends to hook the ball, the toe weight member may be of greater mass than the heel weight member. If the golfer tends to slice the ball, the heel weight member may be of greater mass than the toe weight member.

The recess may be divided into an upper portion and a lower portion, with the insert being positioned within the upper portion and the lower portion remaining hollow. The relative volumes of the upper and lower portions may be designed to produce clubs with different feels. In a preferred arrangement, the upper portion volume is less that the lower portion volume. The lower portion volume may desirably be at least two times the upper portion. The upper volume may be provided with one or more ledges along a lower boundary thereof to facilitate retention of the insert within the upper volume.

BRIEF DESCRIPTION OF THE DRAWINGS

The present invention is described with reference to the accompanying drawings, in which like reference characters reference like elements, and wherein.

DETAILED DESCRIPTION

Other than in the operating examples, or unless otherwise expressly specified, all of the numerical ranges, amounts, values and percentages such as those for amounts of materials, moments of inertias, center of gravity locations, loft angles and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
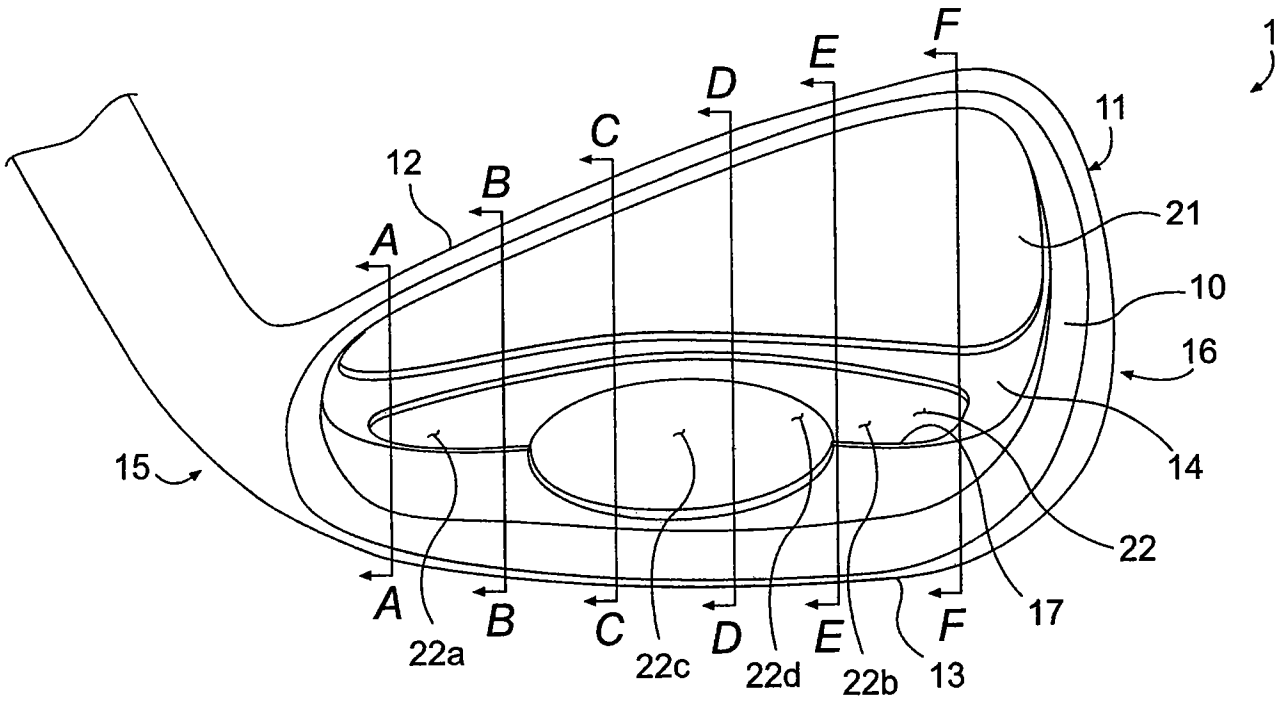
FIG. 1 shows a golf club head of the present invention.

FIG. 1 shows a first golf club head 1 of the present invention. The golf club head 1 includes a body 10 defining a striking face 11, a top line 12, a sole 13, a back 14, a heel 15, and a toe 16. The back 14 contains a cavity 21 and a recess 22. The cavity 21 extends in a direction substantially perpendicular to the face 11, and the recess 22 extends away from the cavity 21 and toward the sole 13. Preferably, the club head 1 is an iron-type golf club head.

The recess 22 removes material from the central portion of the club head 1, which inherently provides more of the club head mass towards the perimeter of the club head 1, producing a greater moment of inertia (MOI) measured about a vertical axis passing through the club head center of gravity and increasing the size of the club head sweet spot. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits. Moving or rearranging mass to the club head perimeter enlarges the sweet spot and produces a more forgiving club. To increase this effect, the recess 22 has a varying depth. The recess 22 includes a heel portion 22*a* including a first depth, a toe portion 22*b* including a second depth, and a central portion 22*c* intermediate the heel and toe portions 22*a*, 22*b* including a third depth. The third depth is greater than the first and second depths, displacing more mass to the perimeter of the club head 1. The first and second depths may be substantially equal. Alternatively, the relative depths of the recess 22 may be different. In a first alternative, the first depth is greater than the second depth, which places more mass toward the toe 16. This may be desired for a golfer that tends to hook the ball, since biasing the club head center of gravity toward the toe 16 makes it harder to close, decreasing the likelihood of closing the club head too soon or too much at impact. In a second alternative, the first depth is less than the second depth, which places more mass toward the heel 15. This may be desired for a golfer that tends to slice the ball, since biasing the club head center of gravity toward the heel 15 makes it easier to close, decreasing the likelihood of leaving the club head open at impact.

The third depth preferably is from approximately 0.05 inch to approximately 1 inch. As stated above, difficulty of golf club use increases with a decrease in loft angle and an increase in club length. In other words, difficulty of use increases from the short irons to the long irons. It may therefore be desirable to provide increasing alteration with an increase in difficulty of use. The recess 22 may be shaped differently for each club in the set or for different groups of clubs within the set. In this instance, the recess 22 is more accentuated for the long irons than for the short irons. Preferred depths for the short irons include from approximately 0.05 inch to approximately 0.5 inch, and preferred depths for the middle and long irons include from approximately 0.2 inch to approximately 1 inch.

The recess 22 preferably also has a variable draft angle .alpha. as an additional mode of enlarging the sweet spot and producing a more forgiving club. The draft angle .alpha. is the angle within the recess 22 between the club head back 14 and a rear wall 17, which define the recess 22. The heel portion 22*a* includes a first draft angle, the toe portion 22*b* includes a second draft angle, and the central portion 22*c* includes a third draft angle, where the third draft angle is greater than the first and second draft angles. In other words, the central portion of the recess 22 has a greater width than the heel and toe portions This further displaces mass from the central region to the perimeter of the club head 1 and increases the MOI. The first and second draft angles may be substantially equal. Alternatively, the relative draft angles of the recess 22 may be different. In a first alternative, the first draft angle is greater than the second draft angle, which places more mass toward the toe 16. This may be desired for a golfer that tends to hook the ball, since biasing the club head center of gravity toward the toe 16 makes it harder to close, decreasing the likelihood of closing the club head too soon or too much at impact. In a second alternative, the first draft angle is less than the second draft angle, which places more mass toward the heel 15. This may be desired for a golfer that tends to slice the ball, since biasing the club head center of gravity toward the heel 15 makes it easier to close, decreasing the likelihood of leaving the club head open at impact. The first and second draft angles preferably are from approximately 5 degrees to approximately 25 degrees, more preferably from approximately 20 degrees to approximately 25 degrees, and the third draft angle preferably is from approximately 30 degrees to approximately 45 degrees, more preferably from approximately 35 degrees to approximately 40 degrees. Alternatively, the recess 22 is wider in the heel and toe portions than in the central portion.

Optionally, the recess 22 includes a supplemental portion intermediate the central and toe portions 22*c*, 22*b*, such as near cross-section D-D. This supplemental portion has a fourth draft angle and, preferably, the fourth draft angle is greater than the third draft angle. A preferred range for the fourth draft angle is from approximately 35 degrees to approximately 60 degrees, more preferably from approximately 35 degrees to approximately 50 degrees.

Figure 2:
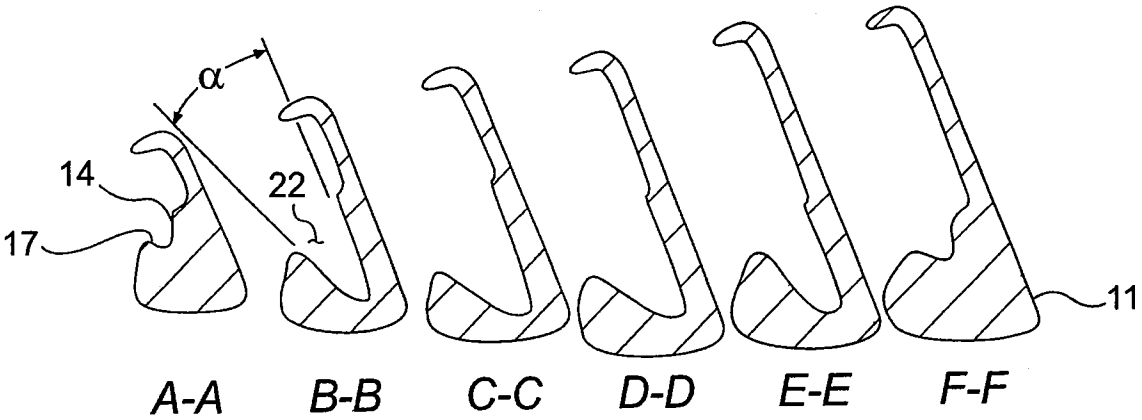
FIG. 2 shows several cross-sectional views through the golf club head of FIG. 1.

FIG. 2 shows several cross-sectional views through the golf club head 1. The cross-sections are taken through multiple locations through the club head 1, from the heel portion 22*a*, through the central portion 22*c*, to the toe portion 22*b*. Cross-section A-A is through the heel portion 22*a* of the club head 1, cross-section F-F is through the toe portion 22*b* of the club head 1, and cross-sections C-C and D-D are through the central portion 22*c*. The cross-sections illustrate the removal of mass from the club head 1 via the recess 22, with more material being removed from the central region than from the toe and heel regions. As shown in the drawing figures, the distance between a top edge (the edge toward the top line 12) of the rear wall defining the recess 22 and the top edge of the front wall defining the recess 22, which front wall may be a rear surface of the wall defining the strike face 11, is greater in a central portion of the club head 1 than in toe and heel portions of the club head 1. Alternatively, this distance may be smaller in the central portion than in the toe and heel portions of the club head 1.

Figure 3:
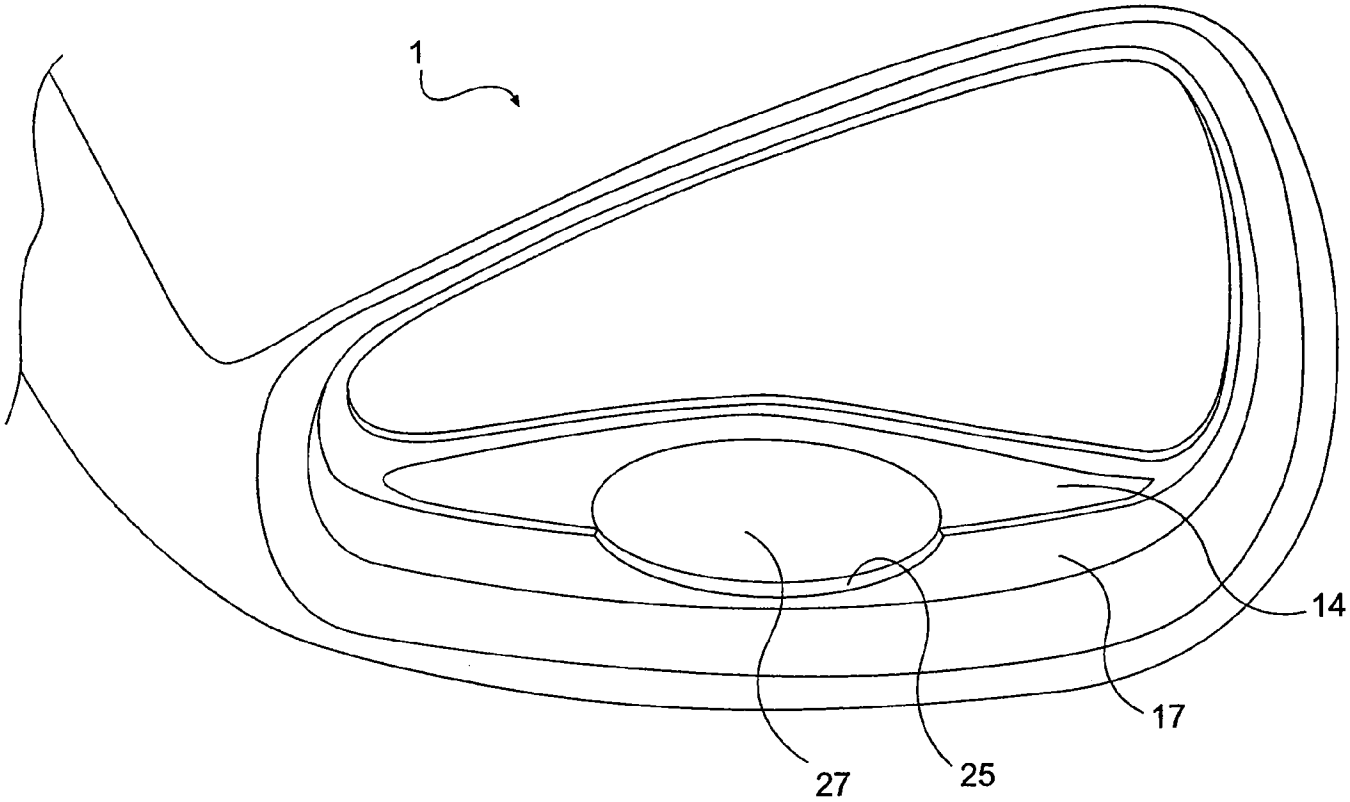
FIG. 3 shows a golf club of the present invention illustrating a cutout feature.

The rear wall 17 may contain a cutout therein. FIG. 3 shows a golf club of the present invention illustrating this feature. As illustrated, rear wall 17 contains a cutout 25 from a central portion thereof. This cutout 25 further removes mass from the center of the club head 1, additionally biasing the mass location to the perimeter. The club head 1 may include an indicia 27, preferably on the back 14 of the club head 1. This indicia 27 may be, for example, a logo or other identifying mark. If an indicia 27 is included, it and the cutout 25 preferably are aligned such that one may view the indicia 27 through the cutout 25. The cutout 25 may take virtually any shape. Contemplated shapes include circular, elliptical, oval, triangular, and trapezoidal. Note that the cutout 25 does not have to contain the entire shape.

Figure 4:
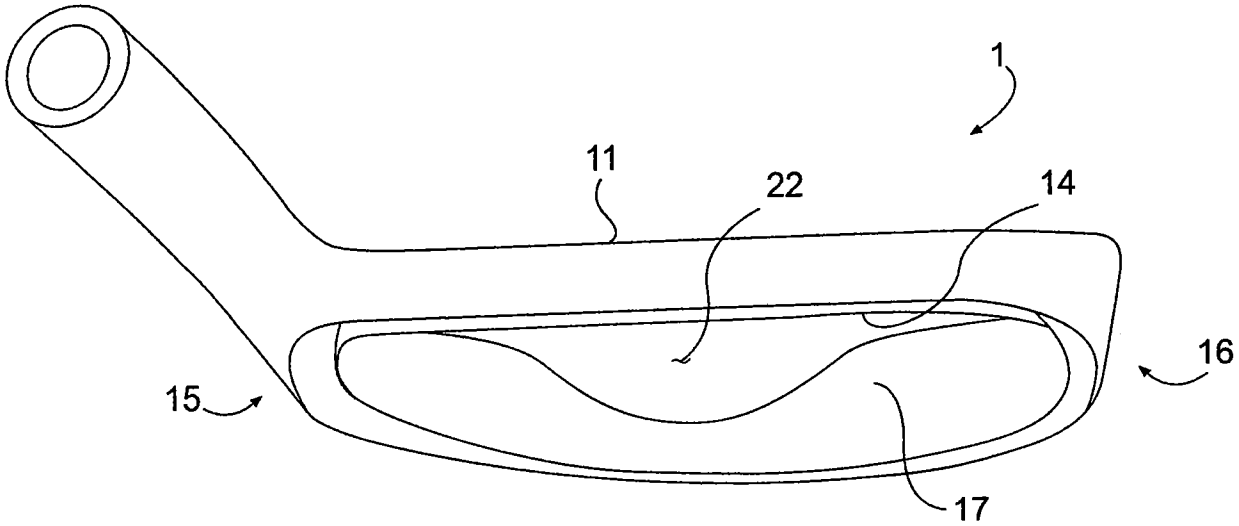
FIG. 4 shows a top view of the golf club of FIG. 3.

Rather, the cutout 25 may take on only a portion of the aforementioned shapes. For example, the cutout 25 may be, at least in part, a trapezoid, such that the cutout 25 takes on the appearance of a chevron. A preferred circular shape has a diameter substantially equal to the diameter of a golf ball, which may be 1.68 inches. The rear wall 17 may be curved outward in a central portion thereof, which enhances perimeter weighting similarly to the increased central draft angle discussed above. FIG. 4 shows a top view of the golf club of FIG. 3, including a curved rear wall 17. The rear wall 17 curves outward in a central portion thereof. Since the toe and heel portions do not curve outward to the extent that the central portion does, there is more material and, therefore, more mass in the heel and toe portions of the club head 1, increasing the club head MOI.

The MOI about a vertical axis passing through the club head center of gravity preferably is greater than approximately 2300 $gmcm^2$. A preferred range of MOI values includes from approximately 2300 $gmcm^2$ to approximately 3000 $gmcm^2$. The MOI values will likely vary from club head to club head throughout the set.

Figure 5:
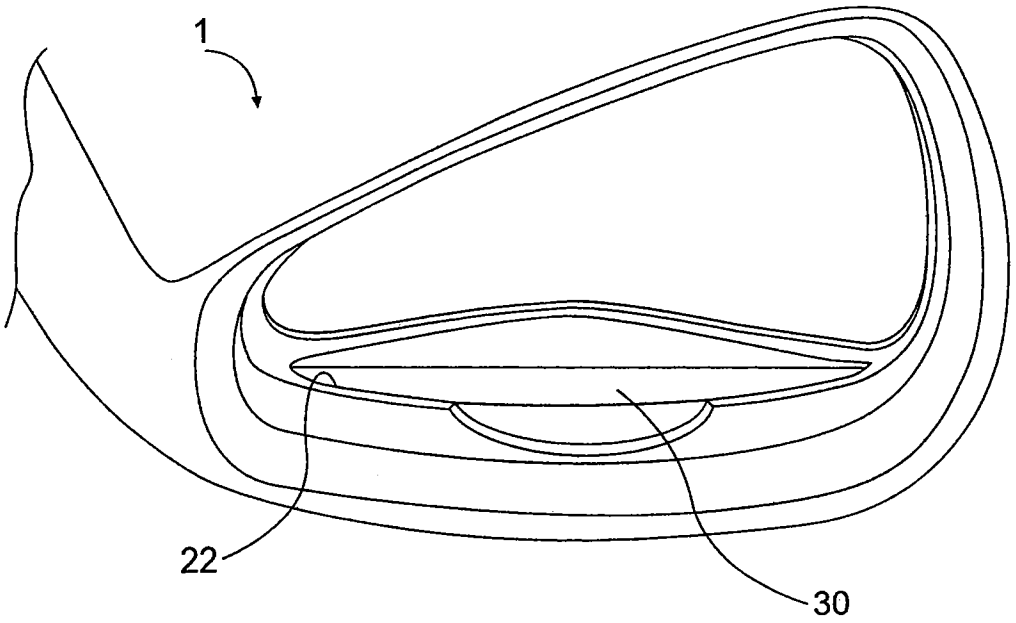
FIG. 5 shows a golf club of the present invention with an insert.

FIG. 5 shows a golf club 1 of the present invention with an insert 30 positioned within the recess 22. The insert 30 may completely fill the recess 22, or may fill only a portion thereof. The insert 30 may be coupled to the club head 1 by an adhesive. Mechanical fasteners, either alone or in conjunction with an adhesive, may also be used to couple the insert 30 to the club head body 10. Exemplary fasteners include screws and bolts. If used, the mechanical fastener(s) preferably extends upward from a bottom portion of the recess 22. The insert 30 may be any desirable type of insert, such as a weight member, a dampening member, a medallion, or a combination of two or more of these examples. Use of a dampening member is useful to diminish vibrations in the club head 1, such as those generated during an off-center hit, and enhances feel and performance of the club. Preferred dampening materials include urethane and rubber. Medallions are useful for providing brand and model information. The medallion may be made of plastic, such as co-molded plastic, or a metallic material, such as stainless steel, or any other appropriate material or composition.

Figure 6:
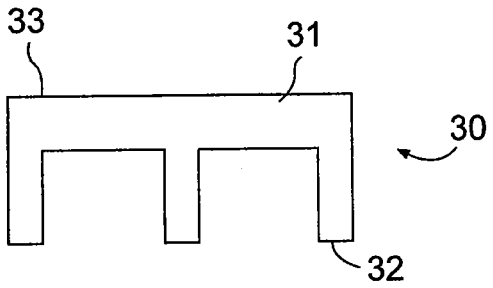
FIG. 6 shows an insert for use with a golf club of the present invention.

FIG. 6 shows a preferred form for the insert 30. The insert 30 includes a main body portion 31 and one or more legs 32 extending from the body 31. While three legs 32 are shown in the illustrated embodiment, any number of legs 32 may be included. The main body 31 includes a top surface 33 that preferably is aligned with the top of the recess 22. The legs 32 extend downward away from the top surface 33. The legs 32 may or may not extend all the way to the bottom of the recess 22. The legs 32 are optional; the insert 30 may alternatively be comprised of only a body member 31. The insert 30 may also include a lower body configured to conform to the bottom surface of the recess 22. This lower body may extend along the entire length of the recess 22 or only a portion thereof.

Figure 12:
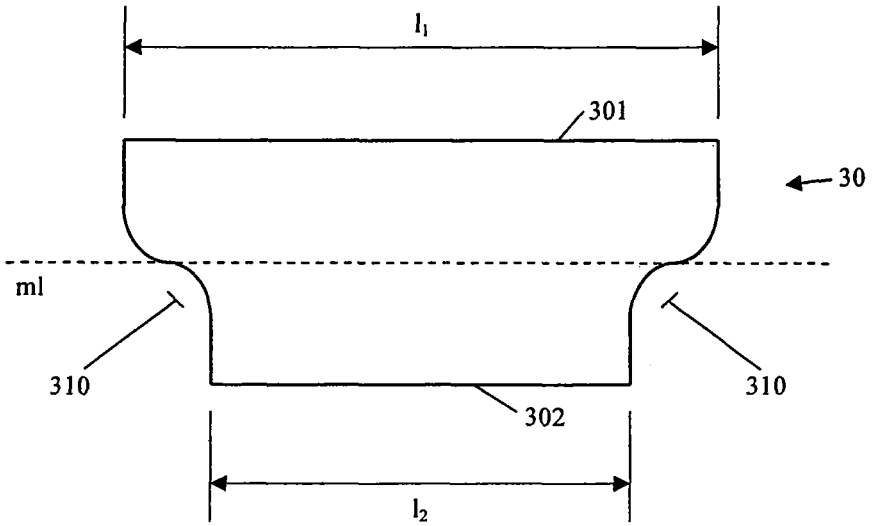
FIG. 12 shows a top view of an insert for use with a golf club of the present invention.

FIG. 12 shows a top view of an insert 30 for use with a golf club of the present invention. In this illustrated embodiment, the insert 30 has a non-uniform cross-sectional shape. The insert 30 has two surfaces 301, 302, with the surface 301 positioned toward the club head face 11 having a bigger area than the surface 302 positioned toward the club head back 14. This may also be characterized by the relative lengths of the surfaces 301, 302—the length 1.sub.1 of the surface positioned toward the face 11 is greater than the length 1.sub.2 of the surface positioned toward the back 14. Preferably, the shorter length 1.sub.2 is ¾ or less of the longer length 1.sub.1. Expressed as a range, the relative lengths may be: 1/21.sub.1.1toreq.1.sub.2.1toreq.3/41.sub.i. The vertical aspect of the insert 30 may be substantially uniform, or it may be tapered or contoured to matingly correspond to the recess 22 having attributes as discussed above, such as a varying depth and/or draft angle.

The transition between the insert regions of differing length and volume may be a gradual one, or it may be more pronounced. The latter may be carried out by providing curvilinear side walls, such as is illustrated in FIG. 12. The illustrated embodiment of FIG. 12 further shows a reference mid-line ml that substantially divides the insert 30 into two portions. The face-side portion includes the larger surface 301, while the back-side portion includes the shorter surface 302. This design results in a larger volume of insert material on the face side of the insert 30 than on the back side of the insert 30. Of course, this means that there is relatively less club head body material in the club head back 14 adjacent the rear surface of the face 11 and relatively more club head body material towards the trailing edge of the club head 1, similarly to the club head 1 of FIG. 4. This results in, for example, a difference of 2 to 10 grams between the club head portions adjacent the insert 30 opposite the mid-line ml. That is, the recess 22 is shaped so as to define wings 310 of the club head body 10 that bias, for example, 2 to 10 grams on the back side of the recess 22. Preferably the relationship of the volumes of the insert portions follow the relationship discussed above with respect to the toe-heel surface lengths—preferably, the volume of the insert rear portion is within the range of one-half to three-quarters of the volume of the insert face portion. In addition to biasing the club head mass towards the heel 15 and the toe 16, which imparts beneficial MOI characteristics as previously explained, this construction also biases the weight toward the back 14 of the club head 1. This beneficially moves the club head center of gravity rearward, so in addition to having increased stability during off-center hits, the resulting golf club also imparts a desired trajectory to a struck golf ball, allowing the golfer to more easily effect an airborne flight path to a struck golf ball.

Figure 7:
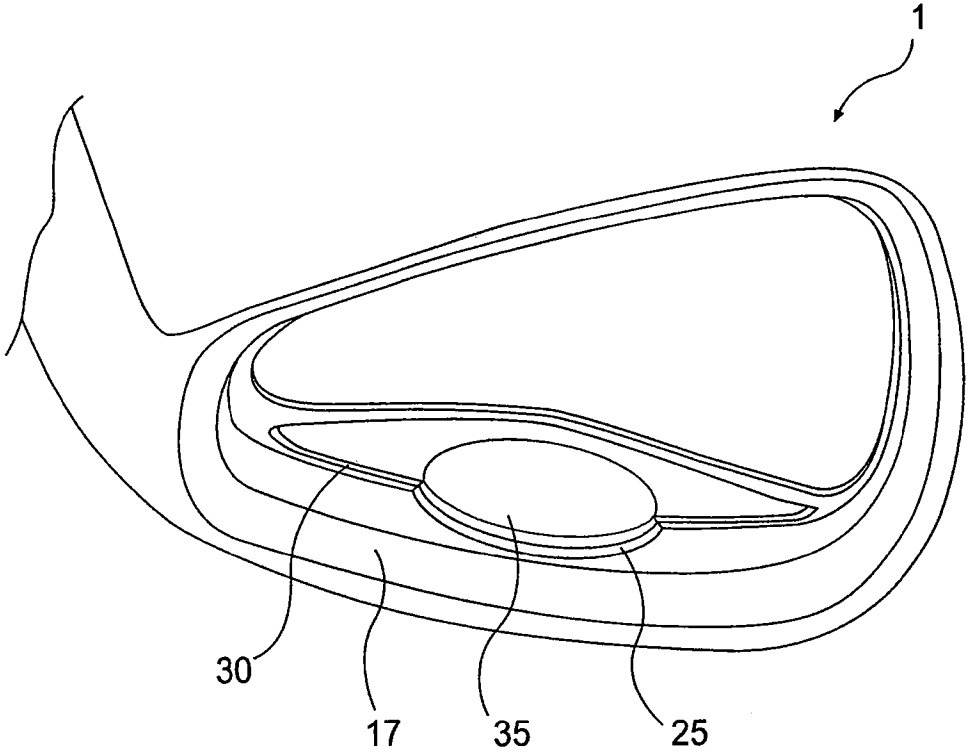
FIG. 7 shows a golf club of the present invention with an insert.

The insert 30 preferably is configured according to the recess 22 in which it will be used. If the recess 22 has a varying depth, the insert 30 will have a varying depth corresponding to the recess depths. Following the discussion above regarding the recess depths, the insert 30 includes a heel portion including a first depth corresponding to the recess first depth, a toe portion including a second depth corresponding to the recess second depth, and a central portion intermediate the heel and toe portions including a third depth corresponding to the recess third depth. Likewise, if the recess 22 has a varying draft angle, the insert 30 will have a varying width corresponding to the recess widths, which are a function of the recess draft angles. Following the discussion above regarding the recess draft angle, the insert 30 includes a heel portion including a first width corresponding to the recess first width, a toe portion including a second width corresponding to the recess second width, and a central portion intermediate the heel and toe portions including a third width corresponding to the recess third width. As illustrated in FIG. 7, if the recess 22 has a cutout 25, the insert 30 will have a corresponding cutout 35 such that the insert 30 is substantially aligned with the top surface of the rear wall 17.

Alternatively, the insert 30 is not configured to mirror the rear wall 17. For example, if the rear wall 17 includes a cutout 25, the insert 30 may be configured without a corresponding cutout such that the insert 30 extends above the rear wall 17 above the cutout 25. In this embodiment, the back 14 preferably contains an indicia 27 aligned with the cutout 25 and the insert 30 preferably is substantially translucent. This allows the indicia 27 to be seen through the insert 30, resulting in a golf club having a novel appearance.

Figure 8:
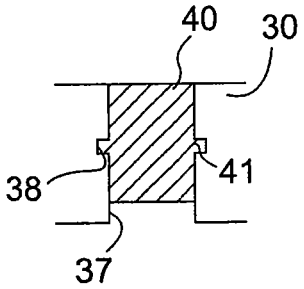
FIG. 8 shows an insert containing a counterbore and second insert for use with a golf club of the present invention.

The insert 30 may define a hole therethrough. This may be desirable if the club head body 10 has an indicia, such as a logo, thereon. The hole preferably is aligned with the indicia such that the indicia is visible through the hole. Alternatively, the insert 30 may include an indentation therein and a second insert may be coupled to the insert 30 within the indentation. In this case, the second insert may contain an indicia thereon. To hold the second insert securely in place, the insert 30 may contain a counterbore and the second insert may be coupled to the insert 30 within the counterbore. The second insert is preferably adapted to be locked in place within the counterbore. A preferred method of locking the second insert within the counterbore is shown in FIG. 8. FIG. 8 shows an insert 30 with a counterbore 37 therein. The counterbore 37 contains a groove 38 therein. A second insert 40 is positioned within the counterbore 37. The second insert 40 contains a tongue 41 that is configured to matingly engage the groove 38 and lock the second insert 40 within the insert 30. The material for the insert 30 preferably is soft to allow insertion into the groove 38. Preferably, the material of the insert 30 has a hardness less than approximately 80 Shore C.

A plate may optionally be coupled to the insert 30, preferably to the top surface 33 of the insert 30. The plate may be perforated, such as with elongated slots. If perforations are included, the insert 30 and the plate preferably are of differing colors such that the insert 30 will be visible through the perforations. Optionally, the plate may contain an indicia thereon. The plate may be formed, at least in part, of one or more of metal, plastic, urethane, or a composite.

Figure 9:
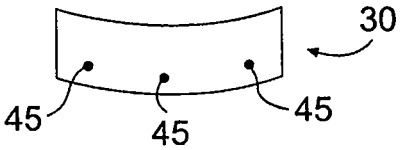
FIG. 9 shows an insert containing secondary inserts for use with a golf club of the present invention.

FIG. 9 shows an insert 30 containing secondary inserts 45 for use with a golf club of the present invention. While three such secondary inserts 45 are shown in the illustrated embodiment, any number of secondary inserts 45 may be included. The secondary inserts 45 may be weight members. The weight members may be of any desired weight, and preferably have a specific gravity greater than a specific gravity of the club head 1.

The weight members 45 may be positioned as desired within the insert 30. A first preferred configuration includes a weight member 45 positioned in a central portion of the insert 30, preferably toward the bottom thereof. This first configuration helps lower the club head center of gravity.

A second preferred configuration includes a first weight member 45 in a heel portion of the insert 30 and a second weight member 45 in a toe portion of the insert 30. In addition to lowering the club head center of gravity, this second configuration also increases the club head MOI. In the second configuration, the masses of the first and second weight members may either be substantially the same, or they may be different. If the golfer tends to slice the ball, it may be desirable to provide a heel weight member with a greater mass than the toe weight member. Conversely, if the golfer tends to hook the ball, it may be desirable to provide a heel weight member with a lesser mass than the toe weight member.

In another embodiment, the insert 30 is a multilayer insert. The insert 30 includes a first insert layer of a first material having a first stiffness, and a second insert layer of a second material having a second stiffness. Preferably, the first insert layer is coupled to the back 14 on a rear side of the face 11 and the second insert layer is coupled to the first insert layer. The second insert layer may be coupled to the first insert layer along any portion thereof, but preferably is coupled to the top surface 33 of the first insert layer. The second insert layer may contain perforations therein, which may be in the form of elongated slots, to allow the first insert layer to be seen therethrough. The elongated slots may be aligned substantially parallel to the longitudinal axis of the golf club head 1, substantially perpendicular to the longitudinal axis of the golf club head 1, or askew to the longitudinal axis of the golf club head 1. The first and second insert layers are preferably of substantially different colors.

Figure 10:
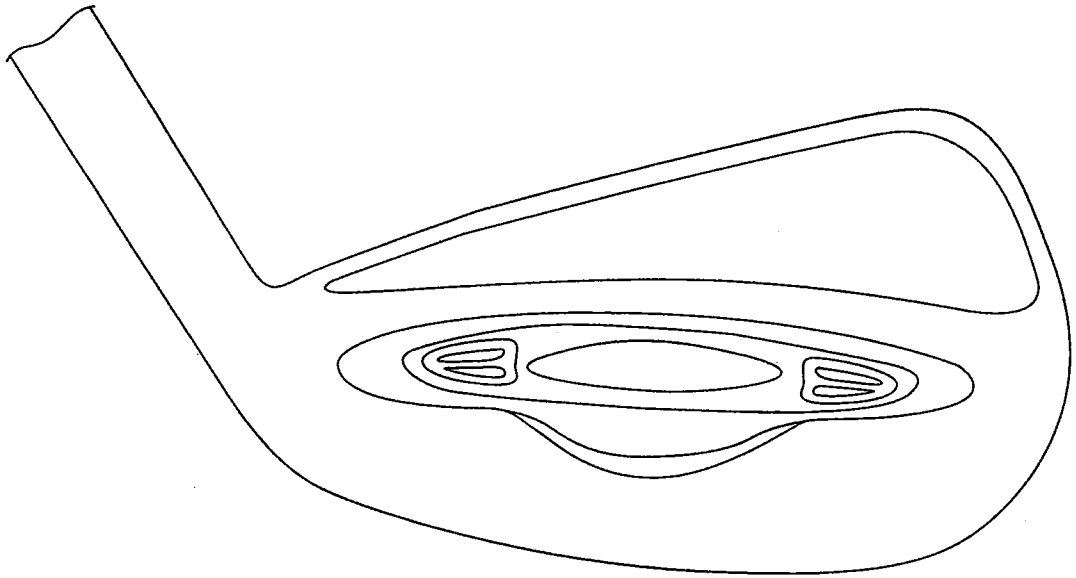
FIG. 10 shows a golf club head of the present invention with a multilayer insert.

These inserts 30 may be formed by a double-shot manufacturing process, and may be formed of urethane, polyurethane, or any other desired material, where the insert 30 is formed in a dual injection process. U.S. Pat. No. 5,924,939 to Grace et al., the disclosure of which is incorporated herein in its entirety, discloses additional inserts that may be used with the present invention. FIG. 10 shows a golf club head 1 with a multilayer insert. The second insert layer has perforations therein, allowing the first insert layer to be visible.

The relative stiffnesses of the first and second insert layers affect the feel of the club. The first stiffness is preferably less than the second stiffness. This setup allows the first insert layer to absorb vibrations, while the second insert layer helps provide a solid feel to the golf club. Alternatively, the first stiffness is greater than the second stiffness and the first insert layer primarily provides stability while the second insert layer primarily absorbs vibrations.

Figure 11:
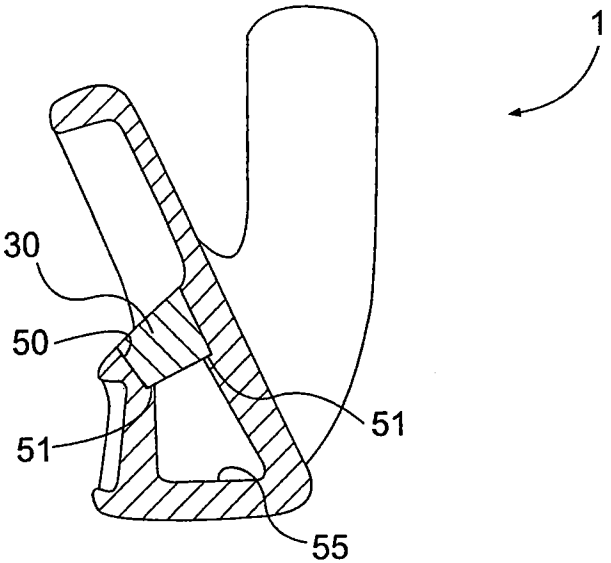
FIG. 11 shows a cross-sectional view through a central portion of a golf club head of the present invention.

FIG. 11 shows a cross-sectional view through a central portion of a golf club head 1 of the present invention. In this embodiment, the recess 22 includes an upper portion 50 having a first volume and a lower portion 55 having a second volume. The insert 30 is positioned within the upper portion 50 and, preferably, substantially fills the upper portion 50. To facilitate positioning of the insert 30 within the upper portion 50, the club head optionally may contain one or more ledges 51 at a lower boundary thereof. These ledges 51 provide a seat upon which the insert 30 may be positioned and to which the insert 30 may be coupled.

Preferably, the lower portion 55 is substantially hollow. Having a hollow lower volume helps produce a more forgiving club with a larger sweet spot. The second volume preferably is greater than the first volume, and more preferably is almost two times the first volume. Preferred volumes for the lower portion 55 include approximately 0.1 $in^3$ to approximately 0.4 $in^3$, with approximately 0.15 $in^3$ to approximately 0.25 $in^3$ being more preferred. Preferred volumes for the upper portion 50 include approximately 0.1 $in^3$ to approximately 0.2 $in^3$, with approximately 0.14 $in^3$ to approximately 0.15 $in^3$ being more preferred. These volumes will likely vary from club head to club head throughout the set.

The use of the terms "a" and "an" and "the" and similar references in the context of describing the invention are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein.

As used herein, directional references such as rear, front, lower, etc. are made with respect to the club head when grounded at the address position. See, for example, FIG. 1. The direction references are included to facilitate comprehension of the inventive concepts disclosed herein, and should not be read or interpreted as limiting.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a body comprising a heel, a toe, a striking face having a front surface and a back surface, and a sole extending away from the back surface of the striking face;

the sole comprising a rear end, a top surface, and a bottom surface, the top surface having a forward inner edge and a rearward outer edge, the forward inner edge defined by the intersection of the top surface of the sole and the back surface of the striking face and the rearward outer edge defined by the intersection of the top surface of the sole and the rear end of the sole;

at least a section of the top surface of the sole including at least a portion of the forward inner edge and the rearward outer edge, the section having a varying height along a length of the forward inner edge relative to a height of a lower outer periphery of the club head in a heel-to-toe direction when the club head is in an address position; and a recess defined between the top surface of the sole and the back surface of the striking face and extending between the toe and heel, wherein the recess has a varying angle defined between the top surface of the sole and the back surface of the striking face along a length of the forward inner edge in the heel-to-toe direction.

2. The golf club head of claim 1, wherein the varying angle of the recess is defined, at least in part, by a contour of the section of the top surface in the front-to-rear direction.

3. The golf club head of claim 2, wherein the contour varies along a length of the forward inner edge in the heel-to-toe direction.

4. The golf club head of claim 1, wherein the forward inner edge is below the rearward outer edge along an entire length of the section of the top surface of the sole in the heel-to-toe direction when the club head is in the address position.

5. The golf club of claim 1, wherein the section of the top surface of the sole has a contour defined between the forward inner edge and the rearward outer edge in the front-to-rear direction.

6. The golf club head of claim 5, wherein the section of the top surface has a substantially concave curvature.

7. A golf club head comprising:

a body comprising a heel, a toe, a striking face having a front surface and a back surface, and a sole extending away from the back surface of the striking face;

the sole comprising a rear end, a top surface, and a bottom surface, the top surface having a forward inner edge and a rearward outer edge, the forward inner edge defined by the intersection of the top surface of the sole and the back surface of the striking face and the rearward outer edge defined by the intersection of the top surface of the sole and the rear end of the sole;

at least a section of the top surface of the sole including at least a portion of the forward inner edge and the rearward outer edge, the section having a varying height along a length of the forward inner edge relative to a height of a lower outer periphery of the club head in a heel-to-toe direction when the club head is in an address position; and a recess defined between the top surface of the sole and the back surface of the striking face and extending between the toe and heel, wherein the recess has a first depth in a heel portion, a second depth in a toe portion, and a third depth in a central portion located between the heel and toe portions, wherein the third depth is greater than the first and second depths.

8. The golf club head of claim 7, wherein the forward inner edge is below the rearward outer edge along an entire length of the section of the top surface of the sole in the heel-to-toe direction when the club head is in the address position.

9. The golf club of claim 7, wherein the section of the top surface of the sole has a contour defined between the forward inner edge and the rearward outer edge in the front-to-rear direction.

10. The golf club head of claim 9, wherein the section of the top surface has a substantially concave curvature.

11. A golf club head comprising:

a body comprising a heel, a toe, a striking face having a front surface and a back surface, and a sole extending away from the back surface of the striking face;

the sole comprising a rear end, a top surface, and a bottom surface, the top surface having a forward inner edge and a rearward outer edge, the forward inner edge defined by the intersection of the top surface of the sole and the back surface of the striking face and the rearward outer edge defined by the intersection of the top surface of the sole and the rear end of the sole;

at least a section of the top surface of the sole including at least a portion of the forward inner edge and the rearward outer edge and a heel-most end and a toe-most end, the section having a contour in the front-to-rear direction and having a varying height along a length of the forward inner edge relative to a lower outer periphery of the club head in the heel-to-toe direction when the club head is in an address position;

a minimum height of the forward inner edge relative to the lower outer periphery of the club head located between the heel-most and toe-most ends;

a maximum difference in height between the forward inner edge and the rearward outer edge located between the heel-most and toe-most ends; and a recess defined between the top surface of the sole and the back surface of the striking face and extending between the toe and heel, wherein the recess has a varying angle defined between the top surface of the sole and the back surface of the striking face along a length of the forward inner edge in the heel-to-toe direction.

12. The golf club head of claim 11, wherein the varying angle of the recess is defined, at least in part, by the contour of the section of the top surface in the front-to-rear direction.

13. The golf club head of claim 12, wherein the contour varies along a length of the forward inner edge in the heel-to-toe direction.

14. The golf club head of claim 11, wherein the forward inner edge is below the rearward outer edge along an entire length of the section of the top surface of the sole in the heel-to-toe direction when the club head is in the address position.

15. The golf club of claim 11, wherein the section of the top surface has a substantially concave curvature.

16. A golf club head comprising:

a body comprising a heel, a toe, a striking face having a front surface and a back surface, and a sole extending away from the back surface of the striking face;

the sole comprising a rear end, a top surface, and a bottom surface, the top surface having a forward inner edge and a rearward outer edge, the forward inner edge defined by the intersection of the top surface of the sole and the back surface of the striking face and the rearward outer edge defined by the intersection of the top surface of the sole and the rear end of the sole;

at least a section of the top surface of the sole including at least a portion of the forward inner edge and the rearward outer edge and a heel-most end and a toe-most end, the section having a contour in the front-to-rear direction and having a varying height along a length of the forward inner edge relative to a lower outer periphery of the club head in the heel-to-toe direction when the club head is in an address position;

a minimum height of the forward inner edge relative to the lower outer periphery of the club head located between the heel-most and toe-most ends;

a maximum difference in height between the forward inner edge and the rearward outer edge located between the heel-most and toe-most ends; and a recess defined between the top surface of the sole and the back surface of the striking face and extending between the toe and heel, wherein the recess has a first depth in a heel portion, a second depth in a toe portion, and a third depth in a central portion located between the heel and toe portions, wherein the third depth is greater than the first and second depths.

17. The golf club head of claim 16, wherein the forward inner edge is below the rearward outer edge along an entire length of the section of the top surface of the sole in the heel-to-toe direction when the club head is in the address position.

18. The golf club of claim 16, wherein the section of the top surface has a substantially concave curvature.

19. A golf club head comprising:

a body comprising a heel, a toe, a striking face having a front surface and a back surface, and a sole extending away from the back surface of the striking face;

the sole comprising a rear end, a top surface, and a bottom surface, the top surface having a forward inner edge defined by the intersection of the top surface of the sole and the back surface of the striking face;

when the club head is in an address position, at least a section of the top surface of the sole including at least a portion of the forward inner edge and rearward outer edge, the section having a contour in the front-to-rear direction, having a varying height along a length of the forward inner edge relative to a lower outer periphery of the club head in the heel-to-toe direction, and having varying curvature in the heel-to-toe direction based, at least in part, on the contour in the front-to-rear direction; and a recess defined between the top surface of the sole and the back surface of the striking face and extending between the toe and heel, wherein the recess has a varying angle defined between the top surface of the sole and the back surface of the striking face along a length of the forward inner edge in the heel-to-toe direction.

20. The golf club head of claim 19, wherein the forward inner edge is below the rearward outer edge along an entire length of the section of the top surface of the sole in the heel-to-toe direction when the club head is in the address position.

* * * * *